US007716815B2

(12) United States Patent
Kim

(10) Patent No.: US 7,716,815 B2
(45) Date of Patent: May 18, 2010

(54) PROCESS FOR FABRICATING A CLOTH-LIKE HEATING ELEMENT WITH TWO PAIRS OF ELECTRICAL CONDUCTORS AND PARALLEL CIRCUITS

(75) Inventor: Tae Moon Kim, Pusan (KR)

(73) Assignee: Bariaq Co., Ltd, Pusan (KR)

( * ) Notice: Subject to any disclaimer, the term of this patent is extended or adjusted under 35 U.S.C. 154(b) by 0 days.

(21) Appl. No.: 11/871,849

(22) Filed: Oct. 12, 2007

(65) Prior Publication Data

US 2009/0094821 A1 Apr. 16, 2009

(51) Int. Cl.
*H05B 3/10* (2006.01)

(52) U.S. Cl. ..... 29/611; 219/515; 219/528; 219/549; 219/545; 29/610.1

(58) Field of Classification Search ..... 29/611, 29/210.1, 610.1; 219/211–212, 217, 345, 219/387, 527–529, 531, 541, 544, 546, 548, 219/549

See application file for complete search history.

(56) References Cited

U.S. PATENT DOCUMENTS 4,581,522 A * 4/1986 Graham ..... 219/545
4,792,662 A * 12/1988 Kitagaki et al. ..... 219/545
6,414,286 B2 * 7/2002 Rock et al. ..... 219/545
6,888,112 B2 * 5/2005 Rock et al. ..... 219/545
7,064,299 B2 * 6/2006 Green et al. ..... 219/515
2002/0104837 A1 * 8/2002 Rock et al. ..... 219/545
2003/0178414 A1 * 9/2003 DeAngelis et al. ..... 219/545
2007/0210074 A1 * 9/2007 Maurer et al. ..... 219/549

FOREIGN PATENT DOCUMENTS

KR 1995-031720 11/1995

* cited by examiner

*Primary Examiner*—Derris H Banks
*Assistant Examiner*—Jeffrey T Carley
(74) *Attorney, Agent, or Firm*—IPLA P.A.; James E. Bame

(57) ABSTRACT

The present invention is a process for fabricating a cloth-like heating element with two pairs of electrical conductors and parallel circuits which are formed via a severing process. A pair of electrical conductors, which looks as a twin belt aligned in parallel, is fabricated on both edges of the heating element by the weaving process; Severing predetermined portions of the inner electrical conductor in order to increase the electrical resistance of heating wires, the pertinent heating wires are connected in series circuitry with each side of the outer electrical conductors; and the heating element is completed when the said process of series linkage is continuously carried out in parallel alignment in accordance with predetermined design.

7 Claims, 2 Drawing Sheets

PROCESS FOR FABRICATING A CLOTH-LIKE HEATING ELEMENT WITH TWO PAIRS OF ELECTRICAL CONDUCTORS AND PARALLEL CIRCUITS

BACKGROUND OF THE INVENTION

1. Technical Field

The present invention relates generally to a cloth-like heating element with two pairs of electrical conductors and parallel circuits which are formed via a severing process.

2. Related Art

An existing cloth-like heating element, Korean Utility Model Registration #1100067, is issued to the same applicant as the present invention, and its functions are as follows:

According to predetermined design, a great number of resistance heating wires are arranged at some intervals between individual threads which wind up on the loom's beam, while a fine copper wire and a thread are used as the weft.

Through the weaving, the resistance heating wires and the copper wires are interlaced with each other to form the heating element, thereby the cloth-like heating element with parallel structure is completed.

The above mentioned cloth-like heating element, which has the benefits induced by parallel circuitry, is only in use with very low voltages (Dc12V, 24V), because in case of increasing the number of heating wires for the purposes of enhancing durability or heat balance of the heating element, the input voltage for the heating element must be relatively decreased.

This is in accordance with Ohm's law, which states that electrical resistance is inversely proportional to the number of heating wires connected in parallel.

Therefore, the above mentioned heating element cannot function under high voltages (AC100V, 220V), which is a fatal weakness.

SUMMARY OF THE INVENTION

The present invention seeks to overcome the above stated problems by providing a cloth-like heating element with two pairs of electrical conductors and parallel circuits, which are formed via a weaving and severing process, whereby it could be hooked to the electrical power source that is high voltages such as AC100 V or AC220V.

BRIEF DESCRIPTION OF THE DRAWING

The drawings described herein are for illustrative purposes only and are not intended to limit the scope of the present invention in any way.

DETAILED DESCRIPTION OF THE INVENTION

The best mode for implementing the present invention will be described hereinafter in detail with reference to the drawings.

Figure 1:
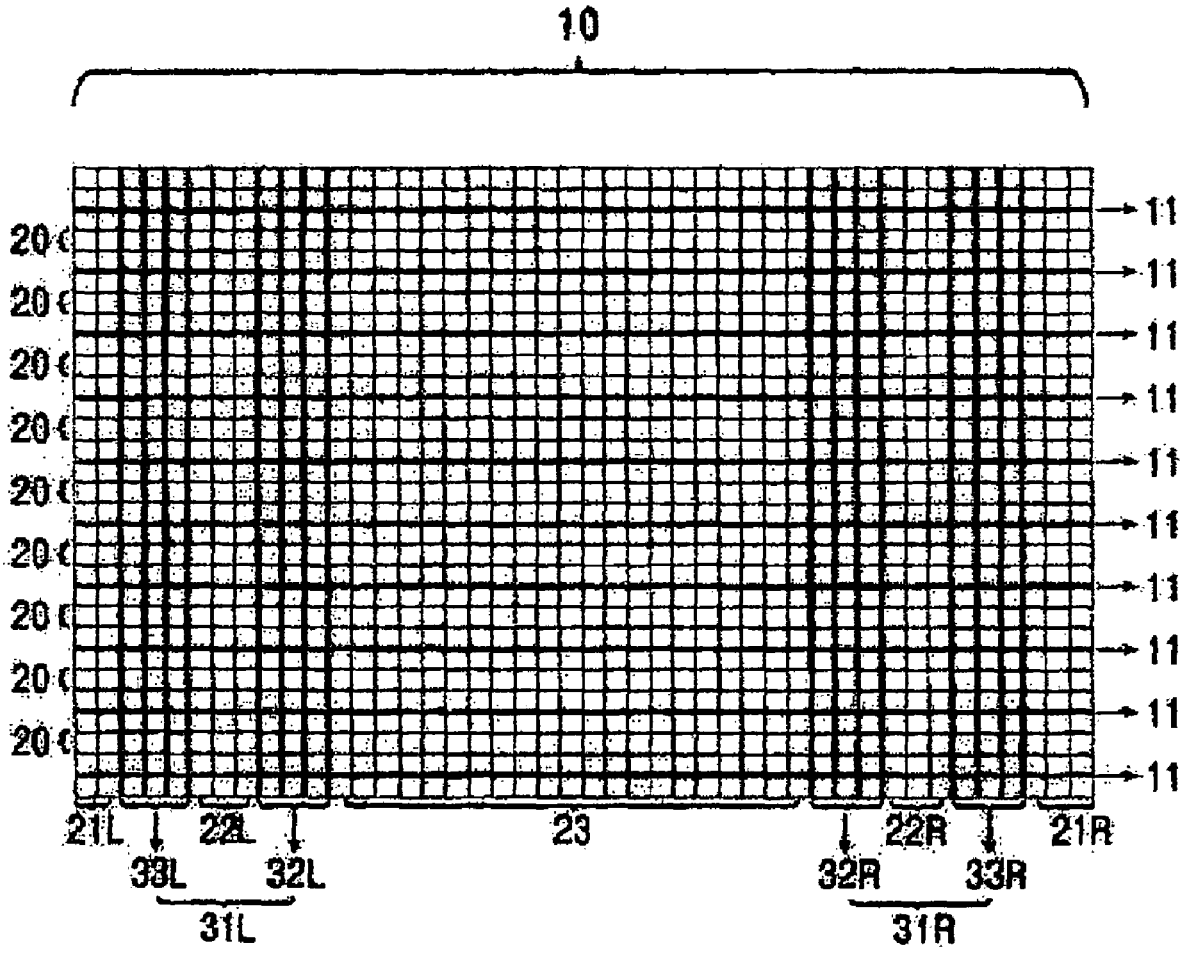
FIG. 1 is a perspective of the heating element with two pairs of electrical conductors in accordance with the present invention.

As Shown in FIG. 1, in order to weave a cloth-like heating element with two pairs of electrical conductors, the appropriate amounts of binding threads 21L/21R, comprised with the first binding threads 21L and the second binding threads 21R are inserted into the heddles of the loom to form the selvedges which keep the edges of cloth-like heating element from unraveling or fraying. As used herein, the terms electrical conductors mean a material which contains movable electric charges such as fine copper wires or fine aluminum wires or the like, and the terms threads mean the weaving threads such as cotton, wool, synthetic fiber or the like, and then, the appropriate amounts of outer electrical conductors 33L/33R comprised with the first outer electrical conductors 33L and the second outer electrical conductors 33R, which shall be connected to a source of electric power to supply electric current to a cloth-like heating element, are continuously inserted into the heddles, and then, the appropriate amounts of threads 22L/22R comprised with the first threads 22L and the second threads 22R, which are used in a space for the severing process, are continuously inserted into the heddles, and then, the appropriate amounts of inner electrical conductors 32L/32R comprised with the first inner electrical conductors 32L and the second inner electrical conductors 32R, which are used in coupling for the series linkage of resistance heating wires 11 are continuously inserted into the heddles. As used herein, the terms coupling means a device used to connect two shafts together at their ends for the purpose of transmitting electric power, and the terms resistance heating wire means a resistance wire converting electricity into heat through the process of Joule heating such as Nichrome wire or the like.

For example, if the load capacity is 500 Watts, the frictional damage by the reed of the loom should be taken into account, and for more reliable coupling with the resistance heating wires 11, the 7 strands of 0.08 mm outer electrical conductors 33L/33R are inserted 16 times into the heddles of the loom, and then, an approximately 15 mm gap, which is filled with threads 22L/22R, is formed continuously in order to have a space for the severing process, after which the 7 strands of 0.08 mm inner electrical conductors 32L/32R are continuously inserted 16 times into the heddles of the loom, and then, the numerous warp threads 23 are continuously inserted into the heddles of the loom to fill between the first inner electrical conductors 32L and the second inner electrical conductors 32R, while the resistance heating wires 11 and the weft threads 20 are used as the weft for weaving, thereby all the preparatory stages for weaving a cloth-like heating element 10 is completed.

Finally, the cloth-like heating element 10 with two pairs of electrical conductors 31L/31R is completed while the weaving is running. As used herein, the terms weaving means the textile art in which two distinct sets of resistance heating wires and electrical conductors or thread, called the warp and the weft, are interlaced with each other to form a cloth-like heating element.

I define both the preparatory stages for weaving a cloth-like heating element with two pairs of electrical conductors and the stages for making the cloth-like heating element, as the description related to weaving set forth above, as the weaving process.

Figure 2:
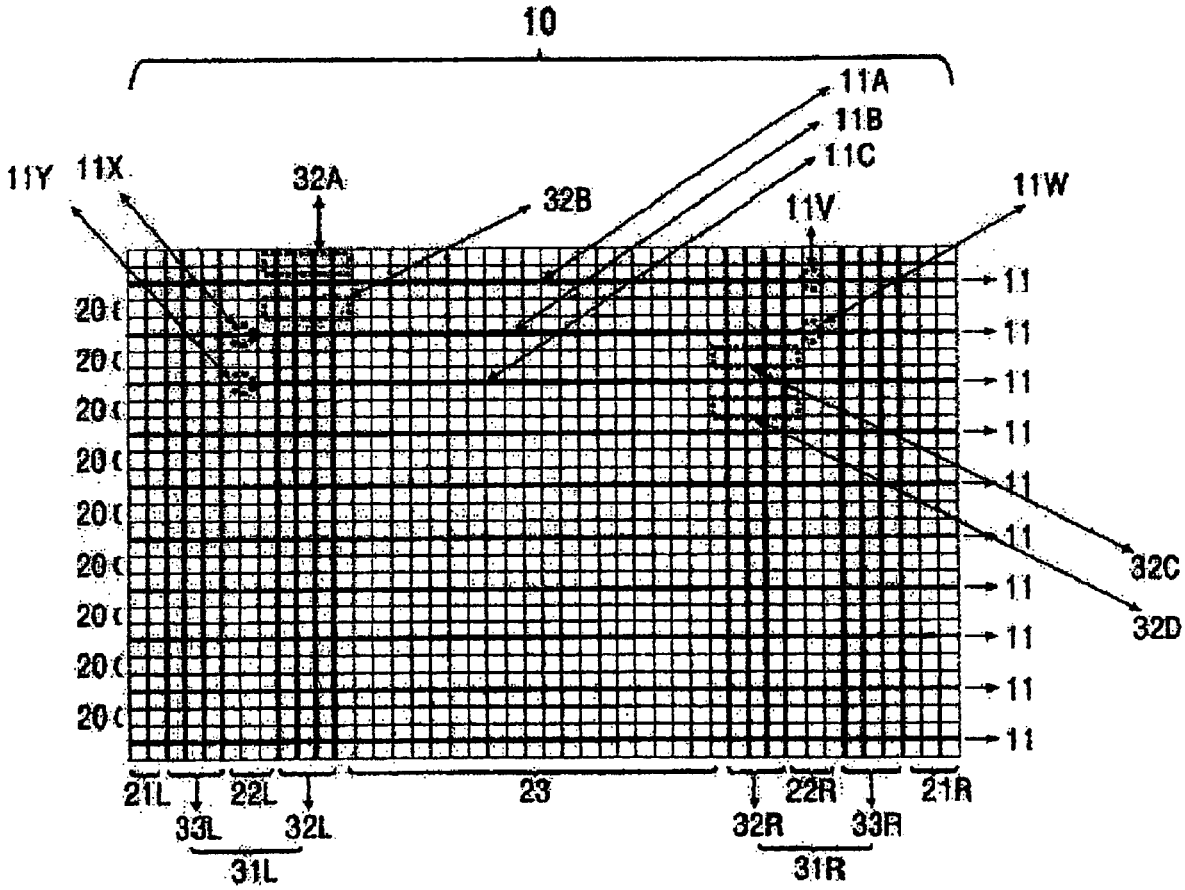
FIG. 2 is an illustration of the severing and connecting process in accordance with the present invention.

Referring to FIG. 2, in order to increase an electric resistance of a resistance heating wire connected in series to be a single path, the 11A and the 11B and the 11C out of the resistance heating wires 11 are perfectly connected in series to be a single path and simultaneously connected with each side of the outer electrical conductors 33L/33R, when the 32A and the 32B of the first inner electrical conductors 32L are severed, and then, the 32C and the 32D of the second inner electrical conductors 32R are severed, and then, the 11V and the 11W out of the resistance heating wires 11 that interlock between the second inner electrical conductors 32R and the second outer electrical conductors 33R are severed, and then, the 11X and the 11Y out of the resistance heating wires that interlock between the first inner electrical conductors 32L and the first outer electrical conductors 33L are severed. Naturally, the severing process can be performed easily via piercing with a press mold.

I define the severing process to mean a process for severing some parts of both a plurality of resistance heating wires 11 used in series linkage and the inner electrical conductors 32L/32R, as the description related to severing set forth above, so that the resistance heating wires are connected in a single path in order to increase the electric resistance of the resistance heating wires used in series linkage. As used herein, the terms some parts mean useless parts severed and eliminated from both a plurality of resistance heating wires 11 used in series linkage and the inner electrical conductors 32L/32R used in series linkage.

And then, by repeating the above mentioned severing process according to the design so that all the resistance heating wires linked in series by means of said severing process are linked in parallel with each side of the outer electrical conductors 33L/33R, the present invention, which has strong points as follows, is completed.

Strong points:

i. The heating element 10 with parallel circuits can be hooked to the high voltages of electrical power source such as AC100V or 220V.

i. Even if one portion of the resistance heating wires or some portion of the heating element could be ruptured, the functions of the heating element will not entirely-break down.

i. Even if the resistance heating wires are severed during use, the malfunction brought by the severed resistance heating wires will theoretically pose no danger of overheating to the user, because the electric resistance of said heating element will be increased in accordance with Ohm's Law.

i. The method of increasing the electrical resistance of heating wires could be acquired easily by utilizing the above mentioned severing process, which would never need connecting methods such as soldering or harnessing terminals.

Example 1

To provide concrete explanations, numerical formulas and illustrations are shown as follows:

It is presumed that the heating element is made with the following conditions.

Conditions are:

Input voltage of 220V;

Load capacity of 500 Watts;

Heating area of 120 cm (Width), 180 cm (Length); and

Electrical-resistance of resistance heating wire is 719 ohms per 1 m.

For the purpose of enhancing the durability and heat balance of the heating element, the resistance heating wires are continuously arranged 1 cm apart.

Hence, 121 resistance heating wires can be aligned to fit the 120 cm width of the heating element.

$$120\text{ cm}+1\text{ cm}+1\text{ cm}=121\text{ strands}$$

The electric resistance of each resistance heating wire is 1294 ohms.

$$1.8\text{ m}\times719\text{ ohms}=1294\text{ ohms}$$

The total electric resistance of the heating element is approximately 97 ohms.

$$R=220\times220+500(\text{cf. } P=V^2/R)$$

R=96.8 ohms

There are many methods to produce the heating element with 97 ohms with use of 121 resistance heating wires, each of which the resistance are 1294 ohms. But, according to experience, the best way to enhance the durability or heat balance of the heating element is to increase the number of resistance heating wires with parallel linkage as much as possible and, to decrease the number of resistance heating wires with series linkage.

Hence, when the 32A and the 32B of the first inner electrical conductors 32L are severed, and then, the 32C and the 32D of the second inner electrical conductors 32R are severed, and then, the 11V and the 11W out of the resistance heating wires 11 that interlock between the second inner electrical conductors 32R and the second outer electrical conductors 33R are severed, and then, the 11X and the 11Y out of the resistance heating wires 11 that interlock between the first inner electrical conductors 32L and the first outer electrical conductors 33L are severed, the 11A, the 11B and the 11C of resistance heating wires are perfectly connected in series to be a single path and simultaneously connected with each side of the outer electrical conductors 33L/33R, and accordingly, its electric resistance is 3882 ohms.

$$1294\Omega\times3\text{ strands}=3882\Omega$$

Hence, repeating the above mentioned severing process 40 times, the heating element, of which electric resistance is 97 ohms, is completed.

$$1+X=3882\Omega=97\Omega$$

X=40 times

Reference;

$$[1/R_{equivalent}=1/R_1+1/R_2+1/R_3\ldots1/Rn]$$

We claim:

1. A process for fabricating a woven heating element with two pairs of electrical conductors and parallel circuits comprising the step of:

(a) fabricating a cloth-like heating element comprising two pairs of electrical conductors via a weaving process;

(b) increasing the electric resistance of a resistance heating wire connected in series to be a single path via a severing process; and (c) making a woven heating element comprising parallel circuits via repeating said step of (b) continuously so that a plurality of resistance heating wires linked in series by means of said step of (b) are connected to each side of outer electrical conductors of the woven heating element.

2. The process for fabricating the woven heating element of claim 1, wherein said two pairs of electrical conductors are comprised of the inner electrical conductors (32L/32R) and said outer electrical conductors (33L/33R).

3. The process for fabricating the woven heating element of claim 2, wherein said two pairs of electrical conductors are fabricated onto both a first (31L) region and a second region (31R) of the woven heating element (10) by the weaving process.

4. The process for fabricating the woven heating element of claim 2, wherein said inner electrical conductors (32L/32R) comprise first inner electrical conductors (32L) and second inner electrical conductors (32R).

5. The process for fabricating the woven heating element of claim 2, wherein said outer electrical conductors (33L/33R) comprise first outer electrical conductors (33L) and second outer electrical conductors (33R).

6. The process for fabricating the woven heating element of claim 2, wherein said inner electrical conductors (32L/32R) are used in couplings for a series linkage of a plurality of resistance heating wires to be a single path.

7. The process for fabricating the woven heating element of claim 2, wherein said outer electrical conductors (33L/33R) interlaced with resistance heating wires (11) are connected to a source of electric power to supply an electric current to the cloth-like heating element.

* * * * *